United States Patent [19]

Casperovich

[11] 4,440,237

[45] Apr. 3, 1984

[54] PAVEMENT BREAKER

[75] Inventor: John J. Casperovich, Bethlehem, Pa.

[73] Assignee: Ingersoll-Rand Co., Woodcliff Lake, N.J.

[21] Appl. No.: 387,694

[22] Filed: Jun. 11, 1982

[51] Int. Cl.[3] ..... F01L 25/02

[52] U.S. Cl. ..... 173/134; 91/232

[58] Field of Search ..... 91/234, 232; 173/134

[56] References Cited

U.S. PATENT DOCUMENTS

| | | | |
|---|---|---|---|
| 1,293,080 | 2/1919 | Gilman | 91/234 |
| 1,703,840 | 2/1929 | Maxson | 91/232 |
| 1,860,736 | 5/1932 | Gartin | 91/232 |
| 1,880,337 | 10/1932 | App | 91/232 |

*Primary Examiner*—Paul E. Maslousky

*Attorney, Agent, or Firm*—Walter C. Vliet

[57] ABSTRACT

A pavement breaker having a valveless piston reciprocating cycle is disclosed. Means is provided for cushioning the shock effect transmitted by the reciprocating piston to the outer housing.

10 Claims, 5 Drawing Figures

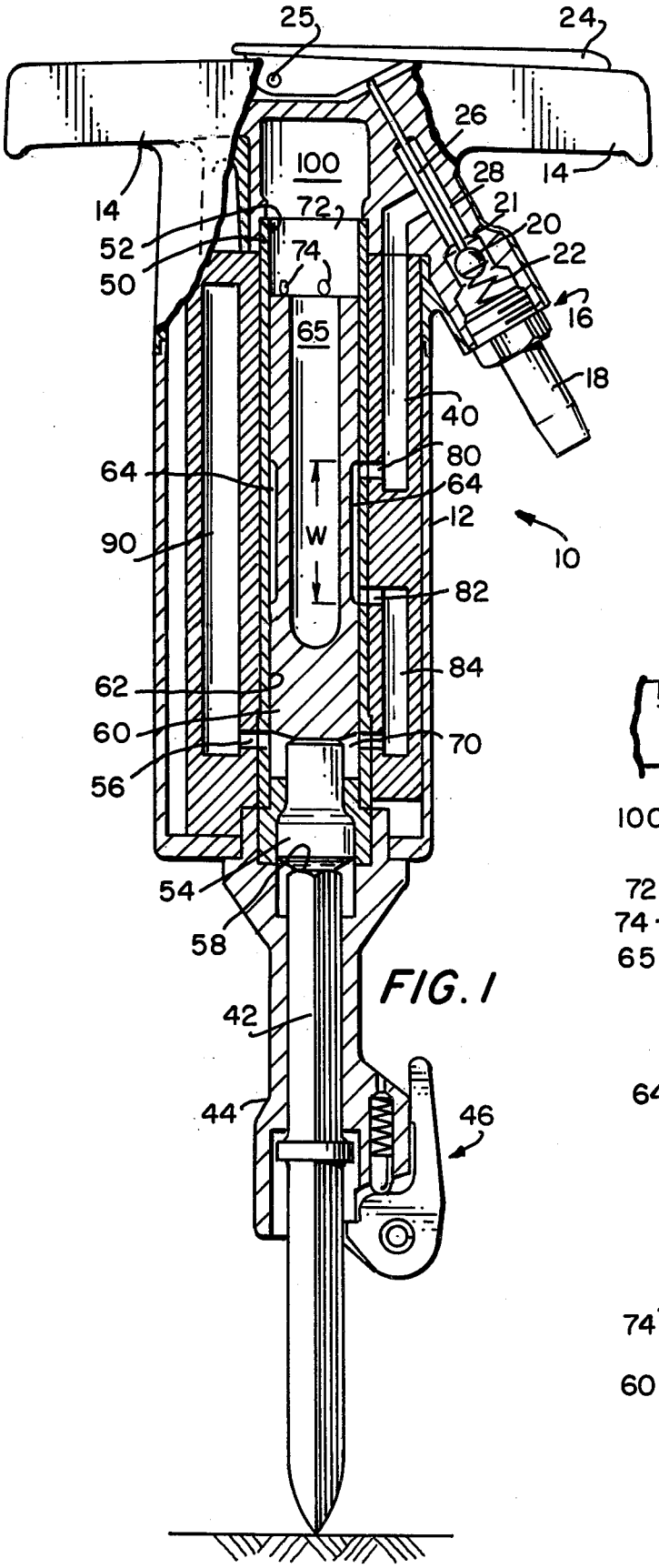
FIG. 1
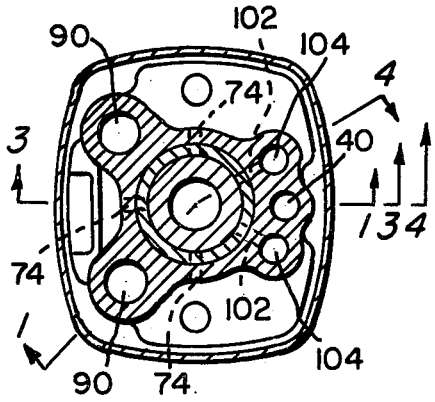
FIG. 2
FIG. 3
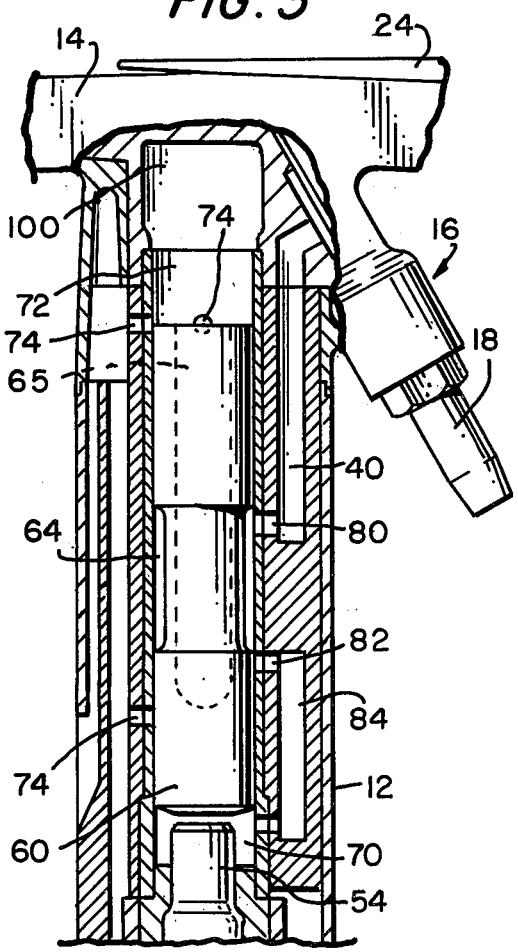

PAVEMENT BREAKER

DESCRIPTION

Background of the Invention

This invention relates to pneumatically-operated pavement breakers and, more particularly, to such breakers utilizing valvless construction.

Valveless pavement breakers are well known. See, for example, Ingersoll-Rand Company breaker model number ABM200 which is designed to be operated while mounted on a backhoe or other piece of construction equipment. The piston is of constant diameter with a circumferential recess about the middle which is in communication with the compressed air inlet. In operation, this recess alternately communicates with first one end of the piston cylinder and then the other. Compressed air is thereby introduced alternately to the two ends of the cylinder imparting reciprocatory movement to the piston. As the piston reciprocates, however a substantial shock effect is transmitted to the breaker housing making this type of breaker construction unsuitable for use in a hand-held unit.

Pavement breakers utilizing an air chamber to cushion the piston during its return stroke and thereby reducing the shock effect are also well known. See, for example, Ingersoll-Rand Company breaker model number BR40 which utilizes a standard valve chest assembly for controlling the flow of compressed air. Additionally, see U.S. Pat. Ser. No. 1,849,208 issued Mar. 15, 1932 to Slatcher which discloses a valveless hand-operated breaker having an air chamber to cushion the piston during its return stroke. The piston is of the differential type having two different working diameters each of which has an annular recess formed therein. These diameters and recesses cooperate with ports and passages formed in the interior cylinder wall to effect a valveless operating cycle. This type of construction, however, is complex and costly to manufacture due to the inherent necessity of maintaining stringent control during the machining of the various mating surfaces.

It is, therefore, an object of this invention to provide a pavement breaker of simple construction that is economical to manufacture.

It is another object of this invention to provide a pavement breaker having a valveless operating cycle.

It is another object of this invention to provide a pavement breaker suitable for hand-held operation having cushioning means for reducing the shock effect of the piston during both its power stroke as well as during its return stroke.

It is another object of this invention to provide a valveless pavement breaker having a simple piston of a single diameter.

SUMMARY OF THE INVENTION

According to the present invention, there is provided a pavement breaker having a valveless operation cycle comprising a housing, an inlet means for introducing compressed gas into the housing, a piston chamber formed in the housing having a first section and a second section, and a piston arranged for longitudal reciprocating movement within the piston chamber between the first and second sections. The piston has a circumferential access about the middle for intermittant fluid communication with the inlet means. First and second expansion chambers are provided in fluid communication with the first and second sections respectively of the piston chamber. First and second vent ports are also provided for venting the first and second sections respectively when the piston is positioned towards the opposite one of the first and second sections of the piston chamber. First and second passages are formed in the housing in fluid communication with the first and second sections respectively and are arranged so that when the piston is positioned toward one of the first and second sections, that section is in fluid communication with the inlet means via the circumferential recess and one of the passages.

DESCRIPTION OF THE DRAWINGS

Other objects, features, and advantage will become more apparent upon reading the following detailed description in conjunction with the accompanying drawings in which:

FIG. 1 is an axial cross-section illustration, taken along lines 1—1 of FIG. 2, of a hand-held pavement breaker showing the piston in contact with the anvil at point of impact;

FIG. 2 is a horizontal cross-section illustration of the breaker shown in FIG. 1;

FIG. 3 is a partial axial cross-section illustration, taken along lines 3—3 of FIG. 2 showing the piston beginning its return stroke;

DESCRIPTION OF THE PREFERRED EMBODIMENT

Figure 4:
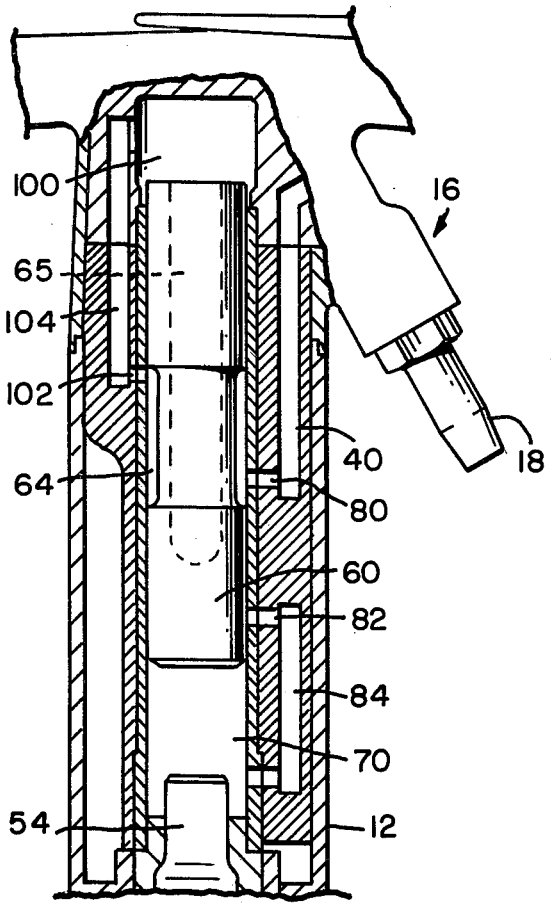
FIGS. 4 and 5 are similar to FIG. 3 but taken along lines 4—4 of FIG. 2 and showing the piston close to the top of its return stroke.

Referring to FIGS. 1 through 5, there is shown a hand-held pavement breaker 10 having a housing 12, handles 14 for grasping by the operator during operation, and a compressed gas inlet assembly shown generally at 16. The inlet assembly comprises an inlet hose 18, a ball valve 20 and associated spring 22, a hand lever 24, one end of which is pivotally attached to the handle at 25, and a connecting rod 26. The spring 22 urges the ball valve 20 against a seat 21 and the rod 26 into engagement with the hand lever 24 thereby pivoting the lever upwardly a slight amount. The rod 26 extends through a manifold 28 which, when the hand lever 24 is depressed, is in fluid communication with the inlet hose 18 and an inlet supply passageway 40. The inlet assembly functions in a notoriously well known manner and will not be described further here. An elongated breaking tool 42 is disposed partially within the lower part 44 of the housing 12 and arranged for limited longitudinal movement. A tool retaining device, also well known in the art, is positioned at the lower end of the housing 12 and is shown generally at 46.

A cylinder 50 having a smooth bore or piston chamber 52 of constant cross-section is arranged within the housing 12 so that its longitudinal axis is coaxial with the breaking tool 42. An anvil 54, of a configuration that is well known in the art, is disposed in the housing 12 between the lower end 56 of the cylinder 50 and the upper end 58 of the breaking tool 42 and is coaxial therewith. A piston 60 of generally cylindrical shape is slidingly disposed within the bore 52 of the cylinder 50. The piston 60 has an outer diameter 62 which sealingly engages the bore 52 around its entire circumference. A circumferential recess 64 having a width W is formed in the outer diameter 62 approximately midway between the two ends of the piston 60, however, the exact positioning of the recess 64 is not critical to the successful practice of this invention except with respect to the ports 80, 82 and 102 as described herein. The piston 60 is formed with a closed ended elongated hollow cavity 65 serving a function that will be described later. The piston 60 defines two sections within the cylinder 50: a first section 70 located adjacent the anvil 54 and a second section 72 located at the opposite end of the cylinder 50, and adjacent the hollow cavity 65 as best seen in FIG. 3. Six exhaust or vent ports 74 are formed in the cylinder 50, three adjacent the first chamber 70 and three adjacent the second chamber 72. As seen in FIG. 3, the exhaust ports 74 are positioned approximately at right angles to each other, the precise positioning of which is not critical except as to their longitudinal positioning which is described below.

A compressed gas supply port 80 formed in the wall of the cylinder 50 is in fluid communication with both the interior of the cylinder 50 and the inlet supply passageway 40. A first distribution port 82 is formed in the wall of the cylinder 50 in approximate alignment with the port 80, with respect to the cylinder axis, and spaced apart therefrom a distance approximately equal to or less than the width W of the circumferential recess 64. The ports 80 and 82 are arranged so that they are in fluid communication with the recess 64 when the piston 60 is positioned in contact with the anvil 54 as shown in FIG. 1. A connecting passage 84 is in fluid communication with both the distribution port 82 and the first section 70. A pair of elongated hollow expansion chambers or cavities 90 are formed in the housing 12, one end of each being permanently closed and the other ends being in fluid communication with the first section 70.

Figure 5:
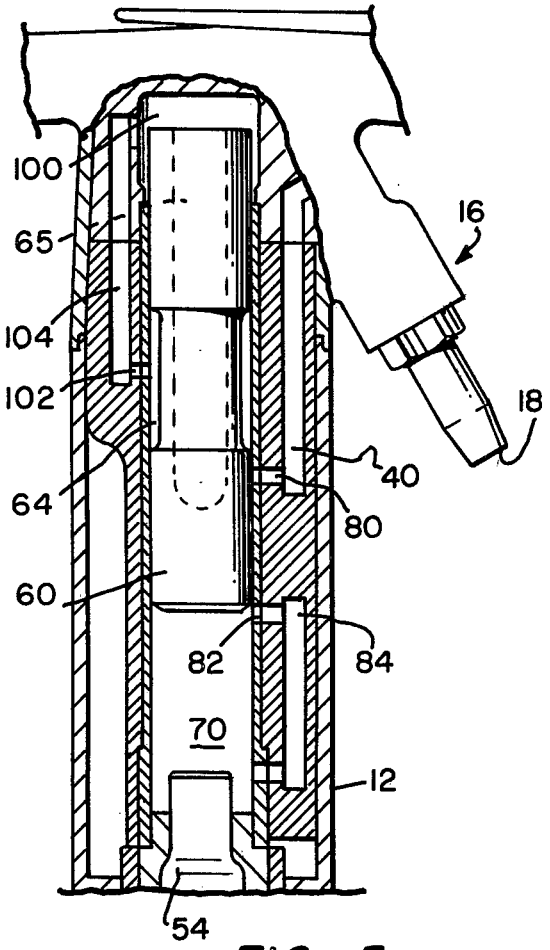

Referring to FIGS. 4 and 5, a compression chamber 100 is formed in the interior of the handle 14 adjacent the second section 72. A pair of distribution ports 102, shown in FIGS. 3, 4 and 5, are formed in the wall of the cylinder 50. A pair of connecting passages 104 are in fluid communication at their one end with the compression chamber 100 and at their other end in fluid communication with the pair of ports 102. The port 80 and the pair of ports 102 are arranged so that they are in fluid communication with the recess 64 when the piston is positioned as shown in FIG. 4; however, when the piston is positioned more toward the compression chamber 100, as shown in FIG. 5, the port 80 and the recess 64 are not in fluid communication.

In operation, the reciprocating piston of the pavement breaker 10 engages an air cushion as it approaches the end of both its power stroke and return stroke, thereby delaying the build up of pressure within the cylinder and reducing the shock effect that is transmitted to the breaker housing. With the ball valve 20 closed against the seat 21, and the breaker in operating position as shown in FIG. 1, the piston 60 is resting against the anvil 54. The second section 72 is vented to the atmosphere through the exhaust ports 74. When the operator depresses the hand lever 24, the ball valve 20 is unseated allowing compressed gas from the inlet hose to flow into the manifold, the inlet supply passageway 40, and through the supply port 80. Since the supply port 80 and the distribution port 82 are both in fluid communication with the recess 64, compressed gas flows into the connecting passage 84, the first section 70, and both of the elongated hollow expansion chambers 90. The build-up of pressure in the first section 70 causes the piston 60 to move toward the second section 72 closing off the exhaust ports 74. At this point, as shown in FIG. 3, the recess 64 disengages the distribution port 82 thereby isolating the first section 70 from the inlet compressed gas. As the gas in the expansion chambers 90 and the first section 70 continues to expand, the piston continues to move toward the second section 72. When the piston 60 reaches the piston shown in FIG. 4, the pair of distribution ports 102 come into fluid communication with the recess 64. Since the supply port 80 is also in fluid communication with the recess 64, compressed gas from the supply port 80 flows through the pair of connecting passages 104 and into the compression chamber 100 and the hollow cavity 65. As the piston continues to move toward the second section 72, the recess 64 disengages the supply port 80, thereby isolating the second section 72 from the inlet compressed gas. Them momentum of the piston 60 continues to carry it toward the second section 72 further compressing the gas trapped in the cavity 65 and the compression chamber 100, thereby absorbing the kinetic energy of the piston causing it to slow down until it reaches the top of its return stroke as shown in FIG. 5.

With the piston positioned at the top of its return stroke the exhaust ports 74, located in the first section 70, are exposed, venting the section 70 to the atmosphere. The compressed gas trapped in the cavity 65 and compression chamber 100 now expands causing the piston 60 to begin moving toward the first section 70. As the recess 64 slides into fluid communication with the supply port 80, inlet compressed gas is again allowed to flow into the compression chamber 100 and cavity 65, as shown in FIG. 4, driving the piston 60 toward the first section 70. As the recess 64 slides past the pair of distribution ports 102, again isolating the compression chamber 100 and cavity 65 from the inlet gas, the exhaust ports 74 located in the first section are blocked by the advancing piston 60. As the piston continues to advance, the gas trapped in the first section 70 and the pair of expansion chambers 90 is compressed somewhat. The piston 60 then strikes the anvil 54 and transmits its energy to the breaking tool 42. The compression of the gas trapped in the pair of expansion chambers 90 reduces the shock effect transmitted to the housing 12 while at the same time delaying build up of pressure in the first section 70. Just prior to striking the anvil 54, the advancing piston 60 exposes the exhaust ports 74 located in the second section 72, thereby venting that chamber to the atmosphere. As described above, again referring to FIG. 1, the recess 64 slides into fluid communication with both the supply port 80 and the distribution port 82, pressurizing the first section 70 and causing the cycle to repeat.

Accordingly, there has been disclosed an arrangement for reducing the shock effect of a reciprocating piston hammer in a pavement breaker having a valveless operating cycle. It is understood that the above described embodiment is merely illustrative of the application of the principles of this invention. Upon reviewing the present disclosure numerous other embodiments may be devised by those skilled in the art without departing from the spirit and scope of this invention, as defined by the appended claims.

I claim:

1. A valveless pavement breaker comprising;

(a) a housing;

(b) an inlet means for introducing compressed gas into said housing;

(c) a piston chamber formed in said housing having a first section and a second section;

(d) a piston having a circumferential recess about the middle and arranged for longitudinal reciprocating movement within said piston chamber between said first and second sections;

(e) a first expansion chamber communicating with said first section of said piston chamber;

(f) a first vent port arranged for venting said first section of said piston chamber when said piston is positioned toward said second section of said piston chamber;

(g) a first passage communicating with said first section of said piston chamber and arranged so that when said piston is positioned toward said first section of said piston chamber said first passage is in communication with said circumferential recess whereby said compressed gas from said inlet means moves said piston toward said second section of said piston chamber;

(h) a second expansion chamber in said piston continuously communicating with said second section of said piston chamber;

(i) a second vent port arranged for venting said second section of said piston chamber when said piston is positioned toward said first section of said piston chamber;

(j) a second passage communicating with said second section of said piston chamber and arranged so that when said piston is positioned toward said second section of said piston chamber said second passage is in communication with said circumferential recess whereby said compressed gas from said inlet means moves said piston toward said first section of said piston chamber; and (k) means for attaching a breaker tool to said housing.

2. The combination as set forth in claim 1 wherein said piston is of cylindrical shape having a single outer diameter of each side of said circumferential recess.

3. The combination as set forth in claim 2 wherein said piston chamber has a smooth continuous internal diameter in sliding and fluid sealing contact with said single outer diameter of said piston.

4. The combination as set forth in claim 3 wherein said first expansion chamber comprises at least one closed ended elongated cavity formed in said housing.

5. The combination as set forth in claims 3 or 4 wherein said second expansion chamber comprises at least one closed ended elongated cavity formed in said piston.

6. The combination as set forth in claim 5 wherein said first passage is out of communication with said circumferential recess when said second passage is in communication therewith.

7. The combination as set forth in claim 6 wherein said second passage is out of cummunication with said circumferential recess when said first passage is in communication therewith.

8. The combination as set forth in claim 1 wherein said circumferential recess is in intermittent communication with said inlet means.

9. The combination as set forth in claim 1 wherein said circumferential recess is in communication with said inlet means dependent on said reciprocating movement of said piston.

10. A valveless pavement breaker having a housing; an inlet means for introducing compressed gas into said housing; a piston chamber formed in said housing having a smooth continuous internal diameter defining a first section and a second section; a cylindrical shaped piston having a single outer diameter arranged for sliding and fluid sealing contact with said internal diameter of said piston chamber, said piston having a circumferential recess formed in said single outer diameter and arranged for reciprocating movement within said piston chamber between said first and second sections; a closed ended elongated cavity formed in said housing and communicating with said first section of said piston chamber; a closed ended elongated cavity formed in said piston and continuously communicating with said second section of said piston chamber; a first passage communicating with said first section of said piston chamber and a second passage communicating with said second section of said piston chamber, said first and second passages arranged so that when said piston is positioned toward said first section of said piston chamber said first passage is in communication with said circumferential recesss and said second passage is out of communication therewith and when said piston is positioned toward said second section of said piston chamber, said second passage is in communication with said circumferential recess and said first passage is out of cummunication therewith; a first vent port formed in said piston chamber and arranged for venting said first section thereof to the atmosphere when said piston is positioned toward said second section; and a second vent port formed in said piston chamber and arranged for venting said second section thereof to the atmosphere when said piston is positioned toward said first section.

* * * * *